US005657861A

United States Patent [19]

Takano et al.

[11] Patent Number: 5,657,861

[45] Date of Patent: Aug. 19, 1997

[54] SLIDE SWITCH

[75] Inventors: Tsunesuke Takano; Kouichi Sinzawa, both of Tokyo, Japan

[73] Assignee: Kabushiki Kaisha T An T, Japan

[21] Appl. No.: 611,253

[22] Filed: Mar. 5, 1996

[30] Foreign Application Priority Data

| | | | |
|---|---|---|---|
| Mar. 28, 1995 | [JP] | Japan | 7-094285 |
| Apr. 3, 1995 | [JP] | Japan | 7-101739 |
| May 18, 1995 | [JP] | Japan | 7-143949 |
| May 22, 1995 | [JP] | Japan | 7-146737 |

[51] Int. Cl.[6] ..... H01H 15/06

[52] U.S. Cl. ..... 200/550; 200/549; 200/547

[58] Field of Search ..... 200/549, 550, 200/551, 540, 541, 542, 537, 547

[56] References Cited

U.S. PATENT DOCUMENTS

| | | | |
|---|---|---|---|
| 4,506,119 | 3/1985 | Tanabe | 200/550 |
| 4,825,020 | 4/1989 | Rao et al. | 200/550 |
| 5,051,549 | 9/1991 | Takano | 200/549 |
| 5,153,401 | 10/1992 | Tseng | 200/550 |

FOREIGN PATENT DOCUMENTS 5-325722 5/1992 Japan .

*Primary Examiner*—David J. Walczak
*Attorney, Agent, or Firm*—Nixon & Vanderhye PC

[57] ABSTRACT

A slide switch includes an electrically insulated support housing having an interior cavity and having an upper wall which defines an opening in communication with the interior cavity. An electrically insulated slide body is slidably disposed within the interior cavity of the support housing so as to be slidably movable reciprocally in an operation direction between first and second positions. The slide body has a knob which projects through the opening defined in the upper wall of the support housing to allow manual movement of the slide body between the first and second positions At least one pair of fixed contacts is disposed parallel, but spaced apart relative, to one another substantially transverse to the operation direction of the slide body The slide body also includes a movable contact sized and configured to be in contact with the pair of fixed conductors when the slide body is in the first position so as to make an electrical circuit therebetween, and to be disengaged from at least one of the fixed conductors when the slide body is in the second position so as to break electrical contact therebetween. The movable contact includes a main elongate contact strip and an auxiliary elongate contact strip disposed in parallel side-by-side relationship to one another in the operation direction of the slide body. The main contact strip includes a main protrusion for contacting the pair of fixed contacts when the slide body is in the first position thereof. The auxiliary contact strip includes an auxiliary protrusion spaced from the main protrusion in the operation direction of the slide body. The auxiliary protrusion thereby contacts one of the fixed contacts when the slide body is being moved from the first position and into the second position to thereby maintain the electrical circuit until the slide body reaches the second position.

16 Claims, 14 Drawing Sheets

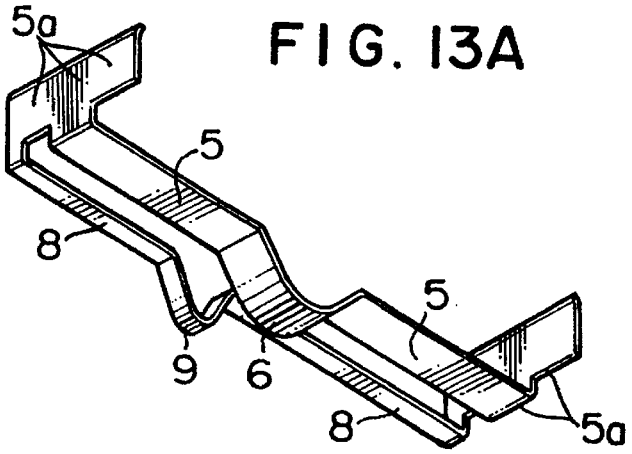
FIG. 13A
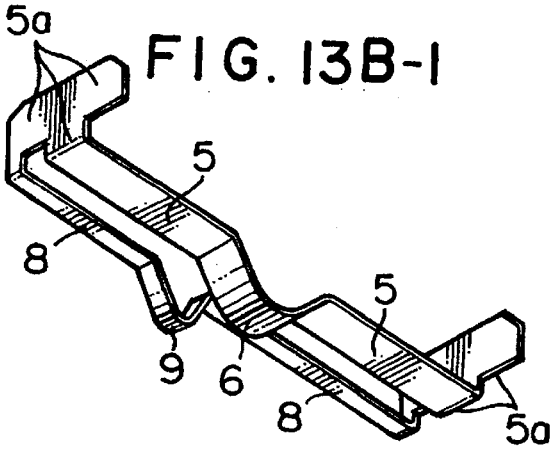
FIG. 13B-1
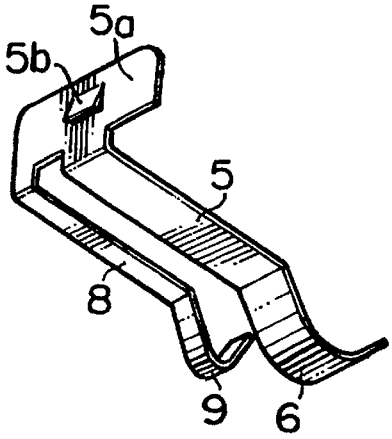
FIG. 13B-2
FIG. 13C-1
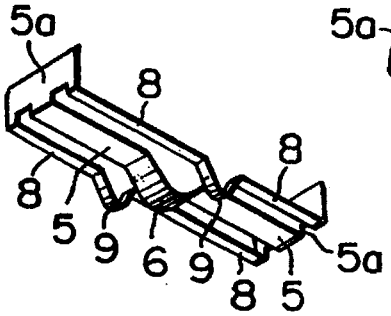
FIG. 13C-3
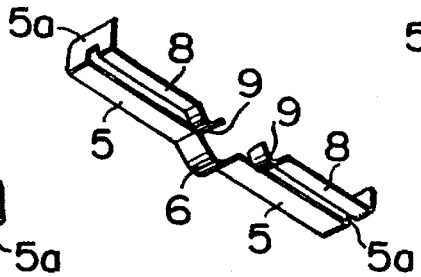
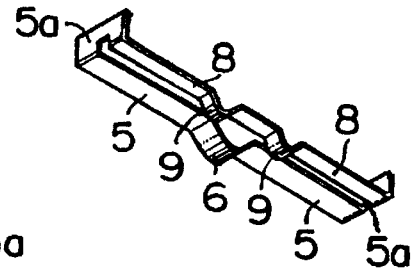
FIG. 13C-2

SLIDE SWITCH

BACKGROUND OF THE INVENTION

1. Field of the Invention

The present invention relates generally to slide-type on/off switches. In preferred forms, the present invention is embodied in slide-type switches that enable the on state to be maintained even though the slide piece is moved slightly. As a result, the slide switches of this invention eliminate premature light extinguishment caused by inadvertent contact with the slide switch.

2. Brief Description of the Prior Art

An example of a conventional slide-type switch is described in Japanese Laid-Open Patent Publication No. 5-325722. In general, this conventional switch consists of a slide switch equipped with a moving contact for the slider. A knob is exposed to the exterior of the switch through an opening in the upper plate of a generally U-shaped insulating base. The insulated slider is able to move within a recession in the insulating base and includes a generally U-shaped resilient conductive strip is arranged therewithin. A plurality of stationary contacts are fixed in a row and define a space therebetween on a lower portion of said insulating base. Contact between the stationary contacts and the resilient conductive strip is established by an intermediate protrusion on the conductive strip. That is, electrical switch contact is caused by the intermediate protrusion making straddling contact between an adjacent pair of the stationary contacts.

One problem associated with the conventional slide switch described briefly above is that the slider knob begins to slide the instant an object inadvertently touches it. As a result of such sliding movement, the intermediate protrusion of the resilient conductive strip is immediately released from contact with one of the stationary contact. Thus, even slight inadvertent movements of the slide knob may cause a light in the switch circuit to be extinguished prematurely (i.e., before the slide switch has been moved to its full "off" position).

SUMMARY OF THE INVENTION

Broadly, one aspect of this invention is a side-type switch that is not turned off inadvertently in response to only slight movements of the slide knob. More specifically, the present invention is embodied in a slide switch whereby respective protrusions of two resilient conductive strips may straddle a plurality of stationary contacts. As such, the automated assembly of the slide switch of this invention may be performed easily without using a coil spring.

The state of the switch immediately after assembly is such that, for example, the protrusion of a resilient conductive strip partially drops between two stationary contacts due to the deflecting resiliency of the resilient conductive strip itself. This state thereby causes the protrusion to make resilient contact by straddling the stationary contacts on both sides. The switch is thus turned on as a result of shorting between the two stationary contacts with the protrusion of said resilient conductive strip.

In order to turn the switch off from the on state noted above, the knob is moved in the off direction (e.g., rightward) which, in turn, causes the protrusion of the resilient conductive strip to first release from the right slope of the left stationary contact and rides up onto the right stationary contact in opposition to the deflecting resiliency of the resilient strip. At this time, an auxiliary protrusion of an auxiliary resilient strip is still making resilient contact with the right slope of the left stationary contact, thereby maintaining the switch in the on state. In this state, there is continuity between the two stationary contacts due to the continuity path extending from the protrusion of the resilient conductive strip to the protrusion of the auxiliary resilient strip via a resilient strip base. Namely, the switch is not turned off even if the knob is moved by roughly half the length of the width of the stationary contacts.

The protrusion of the resilient conductive strip stabilizes after it begins to slide down the right slope of the right stationary contact by moving the knob to the right. Immediately prior to that, however, the auxiliary protrusion releases from the right slope of the left stationary contact and turns the switch off. This off state is maintained by the stability of the protrusion of the resilient conductive strip.

The knob is moved in an opposite direction (e.g., leftward) in order to turn the switch on again. The protrusion of the resilient conductive strip therefore first rides up onto the right stationary contact in opposition to the deflecting resiliency of the resilient conductive strip. The auxiliary contact protrusion makes resilient contact with the right slope of the left stationary contact at which time the switch begins to be turned on as described above. By continuing to move the knob leftward, the protrusion of the resilient conductive strip will then partially drop between the two stationary contacts with a clicking action due to the deflecting resiliency of the resilient conductive strip, thereby shorting the two stationary contacts and securing the on state of the switch.

As a result of the resilient conductive strip that moves with the knob dropping between the stationary contacts (which may be integrated into a single unit with a narrow conductive plate made of a wiring material) a highly beneficial clicking (or snapping) action is created. As a result, switch controllability is improved.

Further aspects and advantages of this invention will become more clear after careful consideration is given to the following detailed description of the preferred exemplary embodiments thereof.

BRIEF DESCRIPTION OF THE DRAWINGS

FIG. 13A is a perspective view showing another example of a moving contact of the present invention.

FIG. 13B is a perspective view showing another example of a moving contact as claimed in ah application example of the present invention.

FIG. 13C is a perspective view showing another example of a moving contact as claimed in an embodiment of the present invention.

DESCRIPTION OF THE PREFERRED EMBODIMENT

Figure 1:
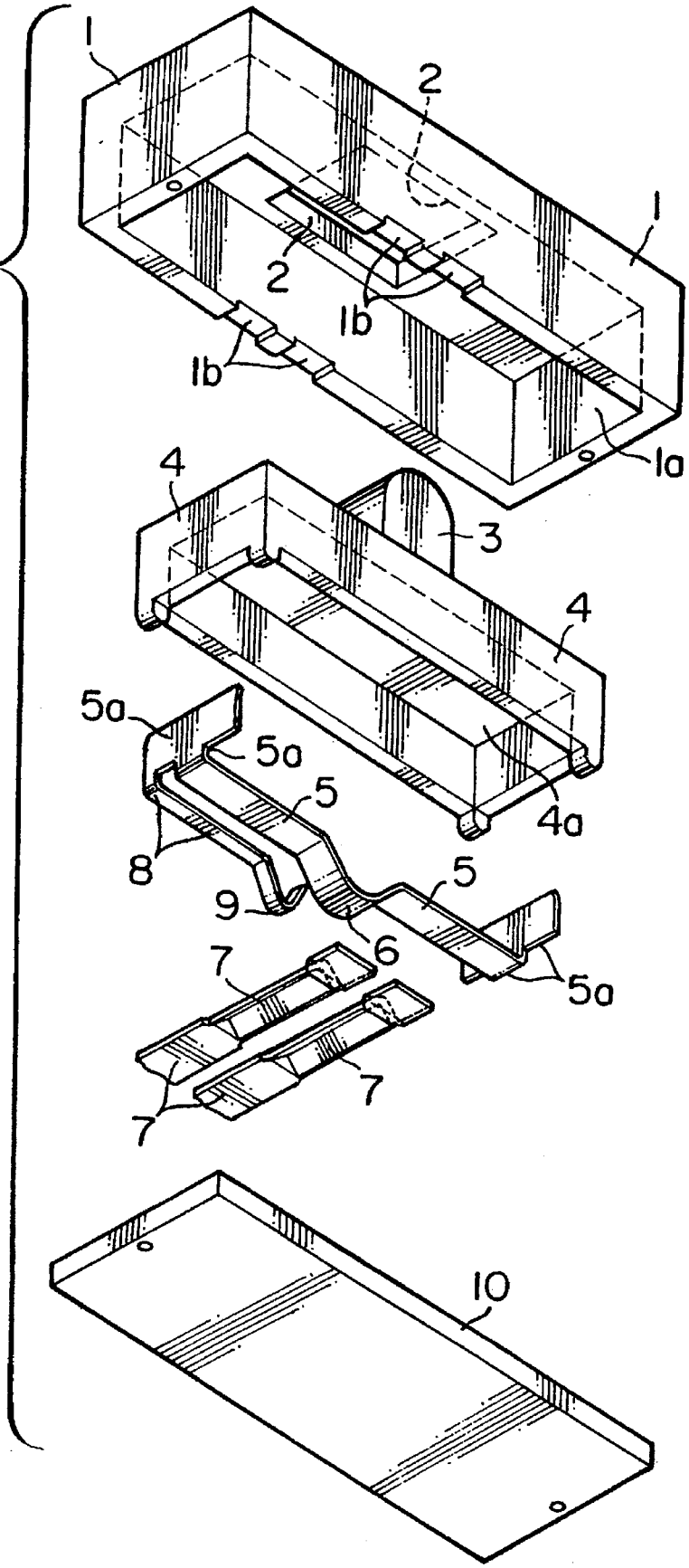
FIG. 1 is an exploded perspective view of the slide switch of the present invention.
Figure 2:
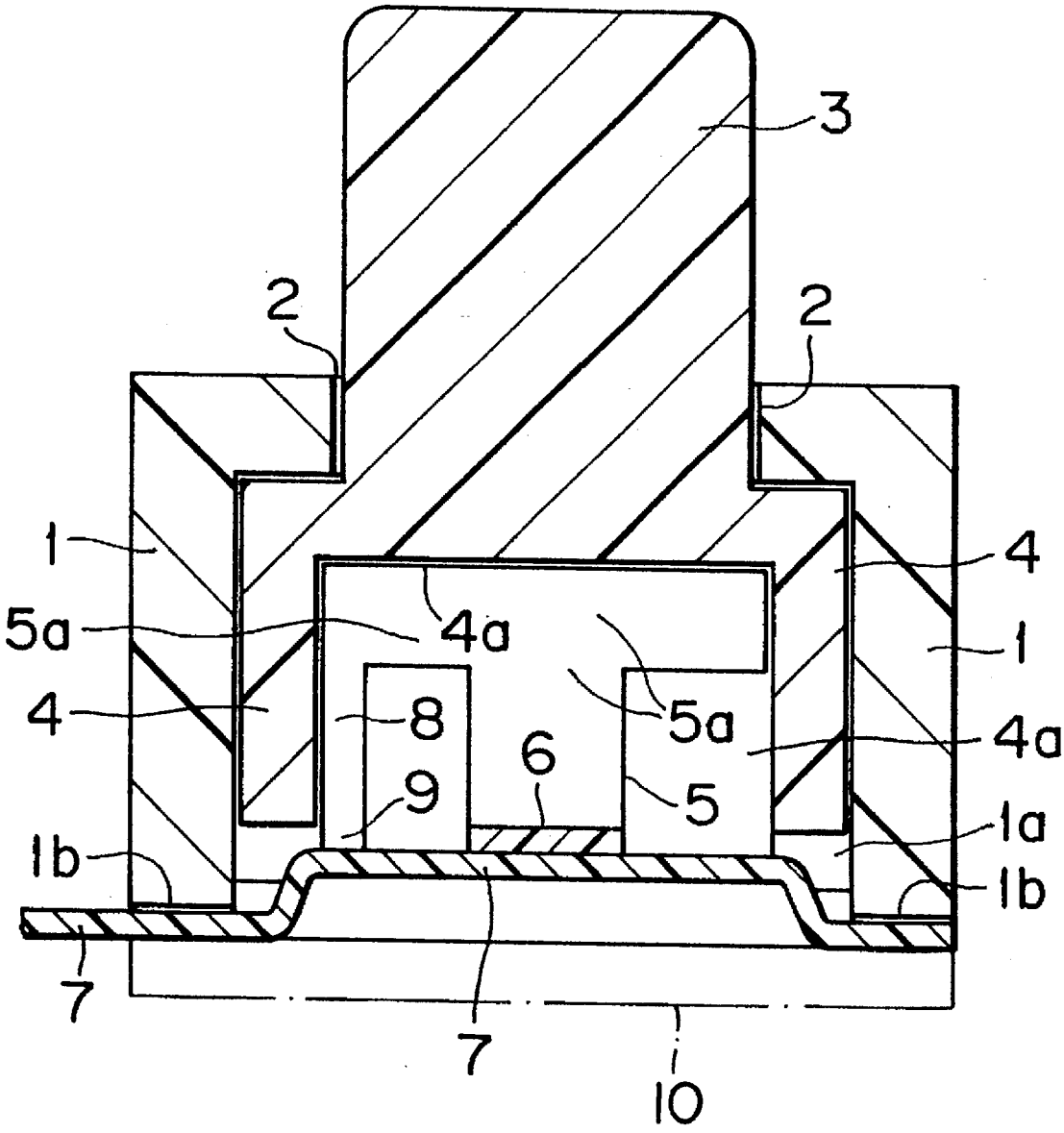
FIG. 2 is an enlarged cross-sectional view of the central cross section of the slide switch after assembly shown in FIG. 1.
Figure 3A:
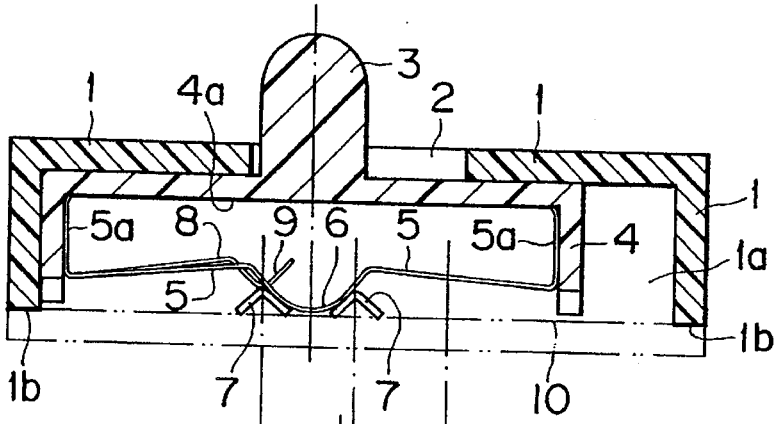
FIG. 3 is a vertical cross-sectional view showing the operating states after assembly of the slide switch shown in FIG. 1.
Figure 3B:
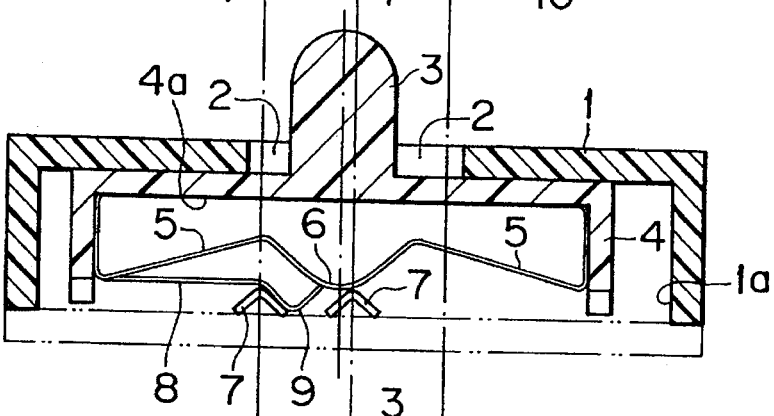
Figure 3C:
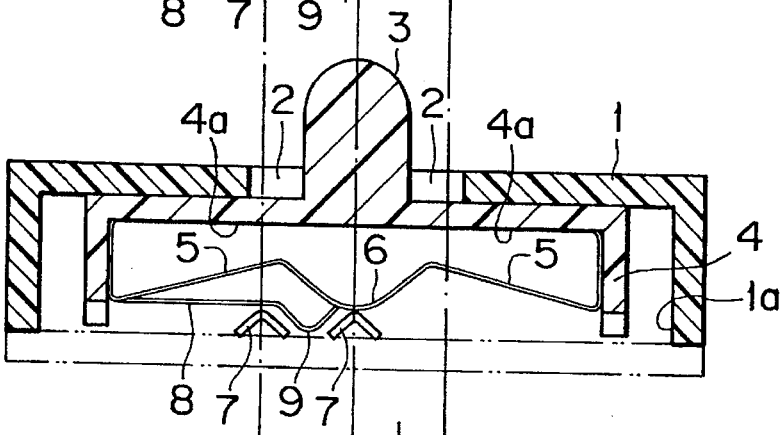
Figure 3D:
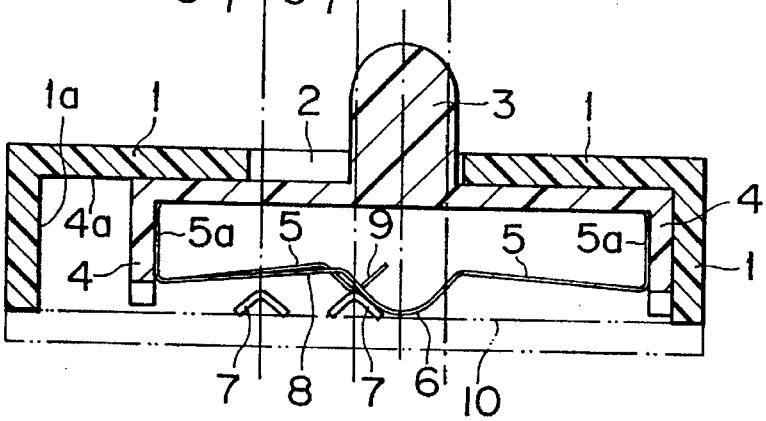

As shown in FIGS. 1–2, the basic constitution of one embodiment of the present invention includes a knob 3 exposed to the outside from opening 2. The knob 3 is provided in, for example, the upper plate of an insulating base 1 (preferably formed from a plastics material) into the shape of a hollow rectangle. The knob 3 is equipped with an open hollow slider 4 (also preferably made of a plastics material) capable of moving within recession 1*a* of the insulating base 1.

Resilient conductive strip 5, made of a resilient electrically conductive material, such as phosphor bronze and the like, resiliently deflects nearly perpendicular to the direction of movement of the slider 4. The conductive strip 5 is arranged by tentatively fixing it within recession 4*a* of said slider 4, with resilient strip bases 5*a* making resilient contact with both of its sides. Protrusion 6 is provided so as to protrude to the outside intermediate to this resilient conductive strip 5.

As shown in FIG. 3(*a*), after the two stationary contacts 7 are positioned, the protrusion 6 makes straddling sliding contact due to the deflecting resiliency of the resilient conductive strip 5 itself. More specifically, the stationary contacts are positioned in a row leaving a space therebetween on the lower opening edge of the insulating base 1 by means of contact embedding grooves 1*b* or the like. An insulating cover 10 is placed over the outside and fixed in position as necessary.

In accordance with the present invention, an auxiliary resilient strip 8 is positioned in parallel, but laterally, to the resilient conductive strip 5 and extends from resilient strip bases 5*a* as shown in FIGS. 1 and 3. The auxiliary strip 8 includes an auxiliary protrusion 9, which makes partial contact with stationary contact 7 on the side on which protrusion 6 is released accompanying movement to the off position of the resilient conductive strip 5.

In addition to the contact embedding grooves 1*b*, the stationary contacts 7 may be fixed to insulating base 1 with screws. Alternatively, the stationary contacts 7 may first be positioned in a row in insulating cover 10. The insulating cover 10 may thereafter be placed over the opening edge of insulating base 1 and fixed in position, thus enabling stationary contacts 7 to be arranged in a row and fixed in position while maintaining a space in between each other at the opening edge of insulating base 1.

The state of the switch shown in FIGS. 1 and 2 immediately after assembly is such the protrusion 6 of resilient conductive strip 5 partially drops between two stationary contacts 7 as shown in FIG. 3(*a*) due to the deflecting resiliency of the above-resilient conductive strip 5 itself, thereby causing the protrusion 6 to make resilient contact by straddling stationary contacts 7 on both sides. The switch is turned on as a result of shorting between the above-mentioned two stationary contacts 7 with protrusion 6 of said resilient conductive strip 5. Furthermore, at this time, auxiliary protrusion 9 of auxiliary resilient strip 8 makes resilient contact with the upper surface of left stationary contact 7 due to its own resiliency.

Next, in order to turn the switch off from the on state shown in FIG. 3(*a*), when knob 3, for example, is moved to the right in the off direction, the protrusion 6 of resilient conductive strip 5 will first release from the right slope of left stationary contact 7 as shown in FIG. 3(*b*). The resilient conductive strip meanwhile will move up the lefthand slope of the right stationary contact 7. At this time, auxiliary protrusion 9 of auxiliary resilient strip 8 is still making resilient contact with the right slope of left stationary contact 7, thereby maintaining the switch in the on state. In this state, therefore, there is continuity between the two stationary contacts 7 due to the continuity path extending from protrusion 6 of resilient conductive strip 5 to auxiliary protrusion 9 of auxiliary resilient strip 8 via resilient strip base 5*a*. That is, the switch is not turned off even if knob 3 is moved by roughly half the length of the width of stationary contacts 7.

Thereafter, continued rightward movement of the knob 3 causes the protrusion 6 of resilient conductive strip 5 to slide down the right slope of right stationary contact 7. The protrusion 6 thus stabilizes after sliding completely down the right slope of the right stationary contact 7 as shown in FIG. 3(*d*). Immediately prior to that, however, auxiliary protrusion 9 releases from the right slope of left stationary contact 7 as shown in FIG. 3(*c*) and turns the switch off. This off state is maintained by the stability of the protrusion 6 of resilient conductive strip 5.

Next, in order to turn the above-mentioned switch on again, if knob 3 is moved to the left in the opposite direction from that of the operation described above, the protrusion 6 of resilient conductive strip 5 will first ride up onto right stationary contact 7 in opposition to its deflecting resiliency as shown in FIG. 3(*b*). The auxiliary protrusion 9 makes resilient contact with the right slope of left stationary contact 7 at which time the switch begins to be turned on as described above. By continuing to move knob 3 to the left, protrusion 6 of resilient conductive strip 5 will then partially drop between two stationary contacts 7 with a clicking action due to the deflecting resiliency of resilient conductive strip 5, thereby shorting two stationary contacts 7 and securing the on state of the switch.

As a result of resilient conductive strip 5 that allows the protrusion 6 to drop between stationary contacts 7 with a clicking (or snapping) action, the controllability of the switch is greatly improved.

Figure 4:
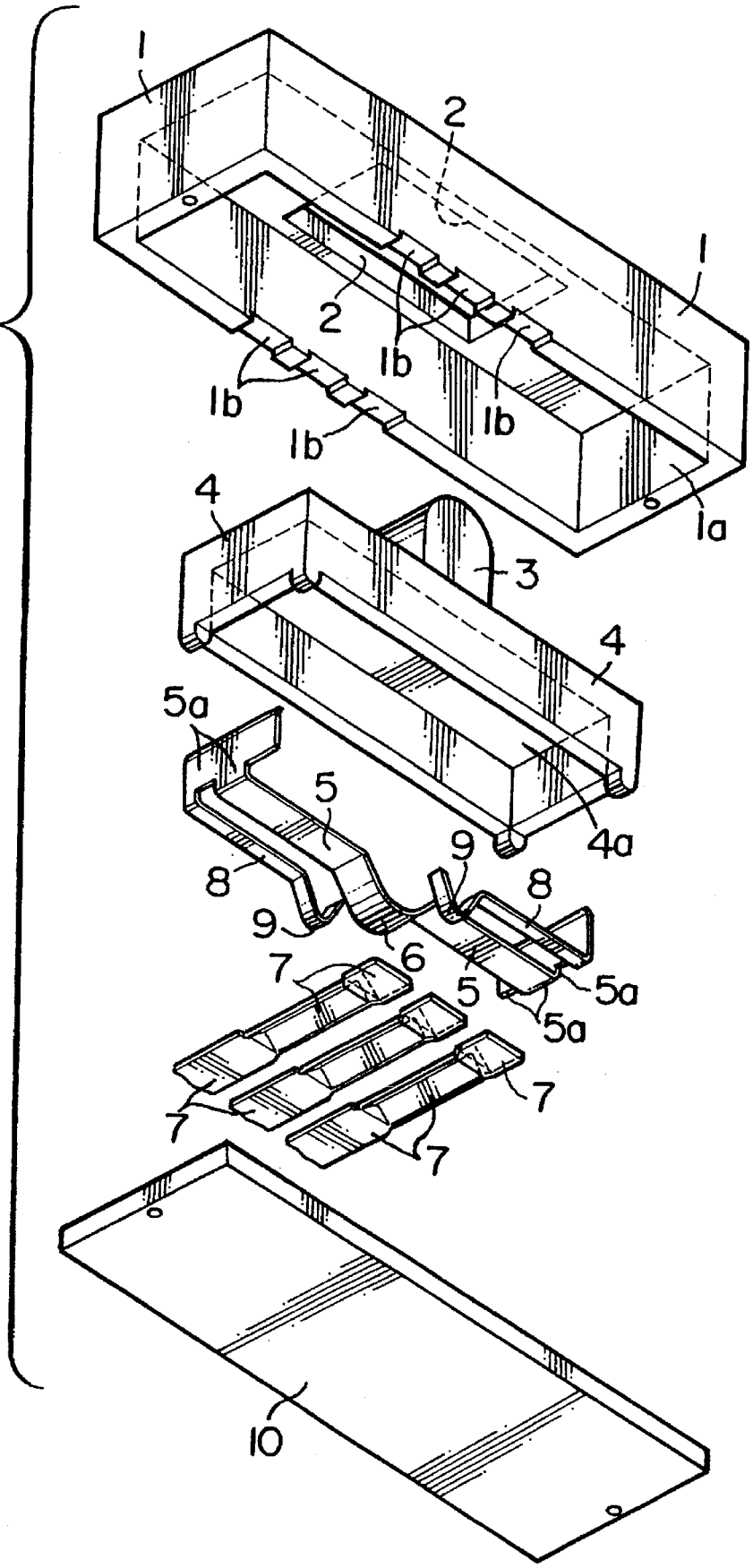
FIG. 4 is an exploded perspective view of a slide switch as claimed in an application example of the present invention.

Another embodiment of the present invention is shown in FIG. 4 and includes a knob 3 exposed as shown in FIGS. 2 and 3 to the outside from opening 2 provided in, for example, the upper plate of a hollow, rectangular insulating base 1. The knob 3 is equipped with a open bottom, hollow slider 4 capable of moving within the recess 1*a* of insulating base 1.

Resilient conductive strip 5 resiliently deflects nearly perpendicular to the direction of movement of the slider 4 and is arranged by tentatively fixing it within recess 4*a* of said slider 4. The resilient strip bases 5*a* thereby make resilient contact with both of its sides. Protrusion 6 is provided in such a manner to protrude to the outside intermediate to this resilient conductive strip 5.

The protrusion 6 makes straddling sliding contact with the stationary contacts 7 due to the deflecting resiliency of the resilient conductive strip 5 itself. that is, the stationary contacts 7 are positioned in a row leaving a space therebetween on the lower opening edge of the insulating base 1 by means of contact embedding grooves 1*b* and the like. Thereafter, the insulating cover 10 is placed over the outside and fixed in position as necessary.

In the embodiment of FIG. 4, a pair of auxiliary resilient strips 8 are provided parallel to and on each lateral side of the resilient strip 5. Moreover, these auxiliary resilient strips 8 protrude inwardly from the resilient strip bases 5*a* in opposite directions to one another. Each of the auxiliary strips 8 is provided with auxiliary protrusions 9, which make partial contact with stationary contacts 7 on the side on which protrusion 6 is released accompanying movement of the off position of the resilient conductive strip 5.

Figure 5:
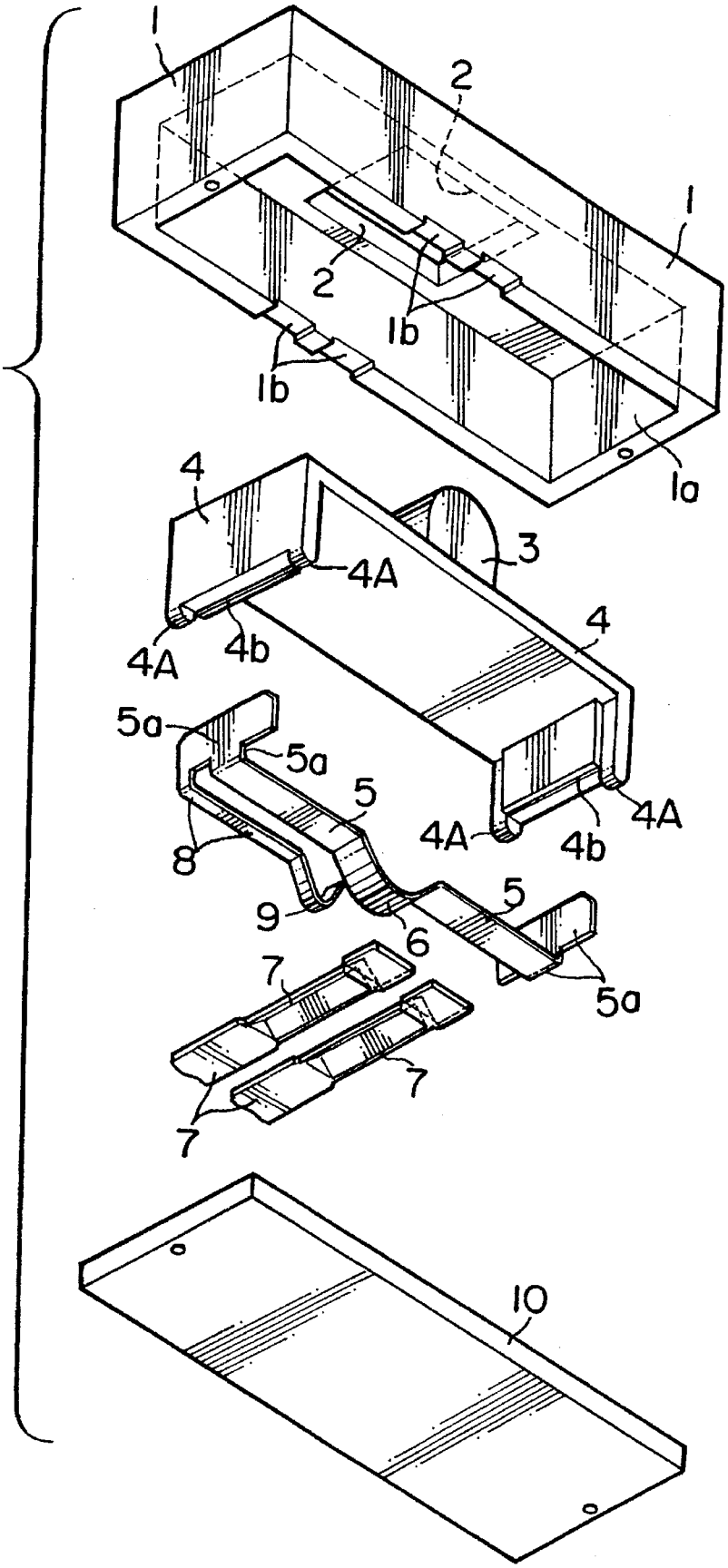
FIG. 5 is an exploded perspective view of a slide switch as claimed in another embodiment of the present invention.
Figure 6:
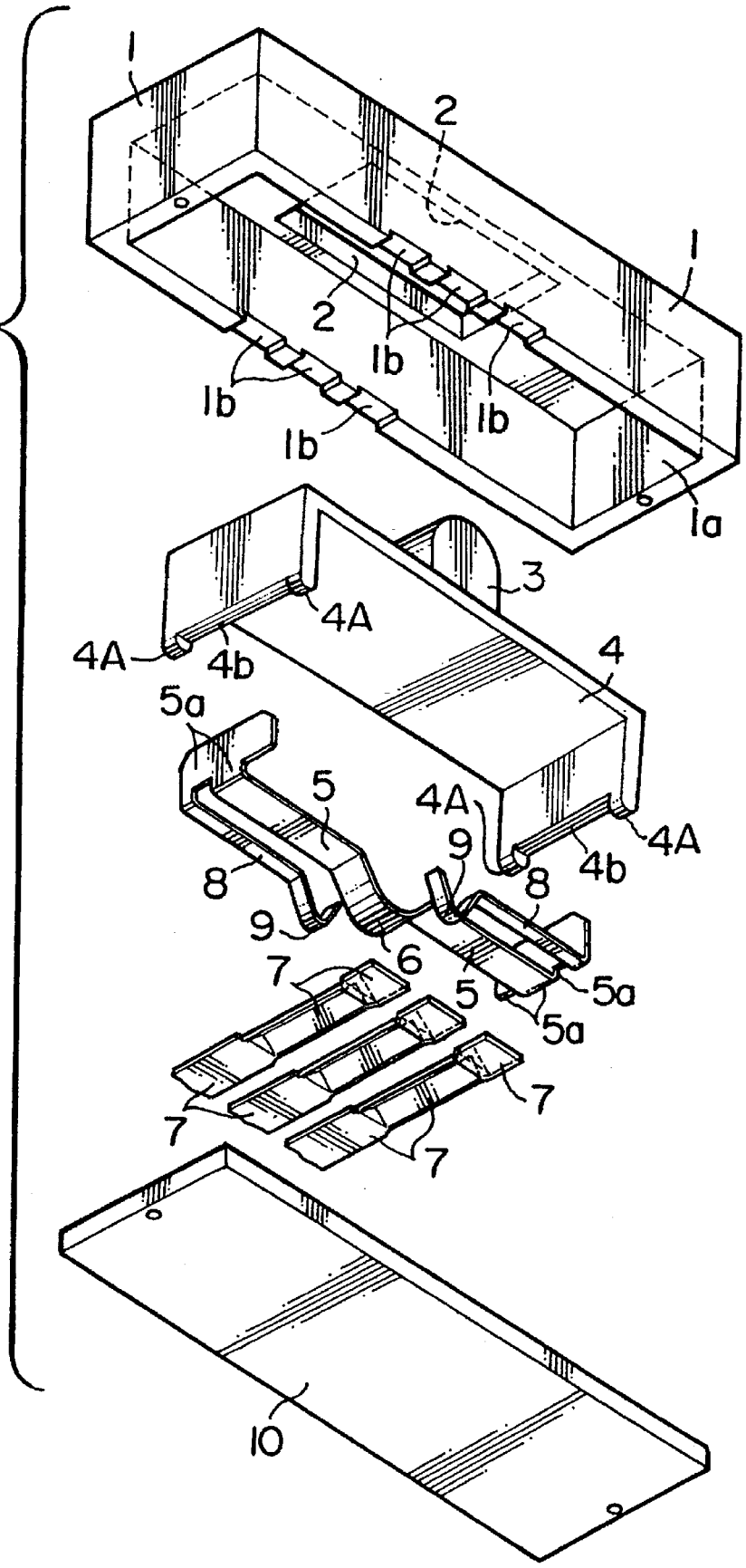
FIG. 6 is an exploded perspective view of a slide switch as claimed in another embodiment of the present invention.
Figure 7A:
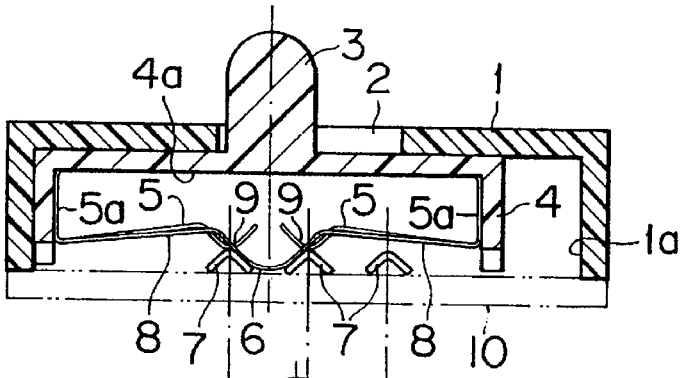
FIG. 7 is a vertical cross-sectional view showing the operating states after assembly of the slide switch shown in FIG. 4.
Figure 7B:
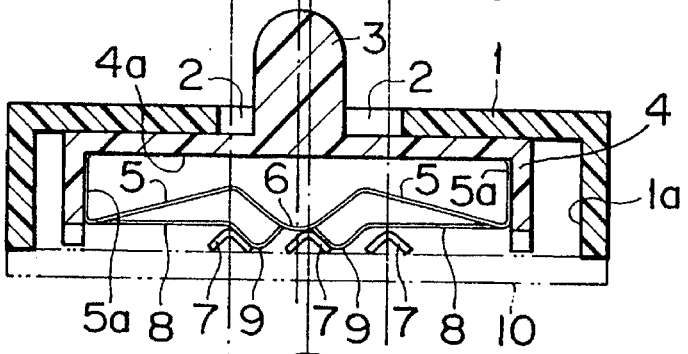
Figure 7C:
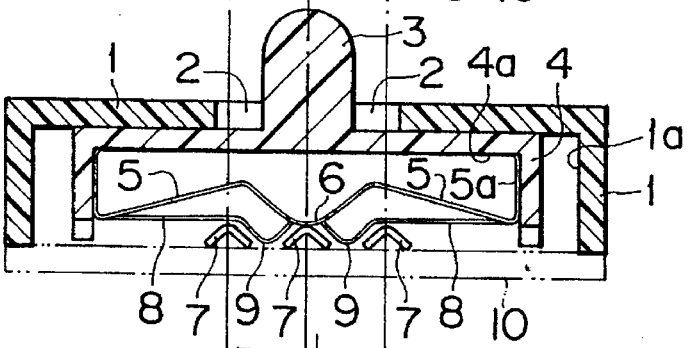
Figure 7D:
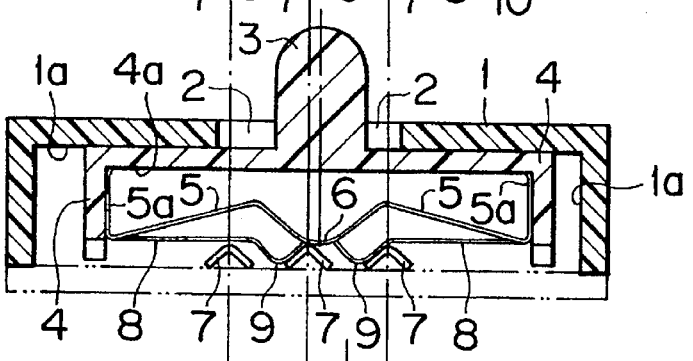
Figure 7E:
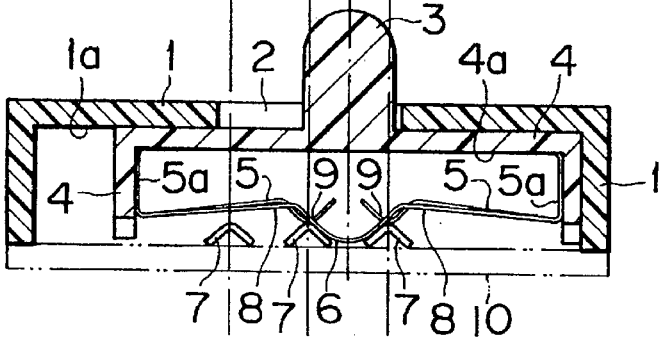
Figure 8A:
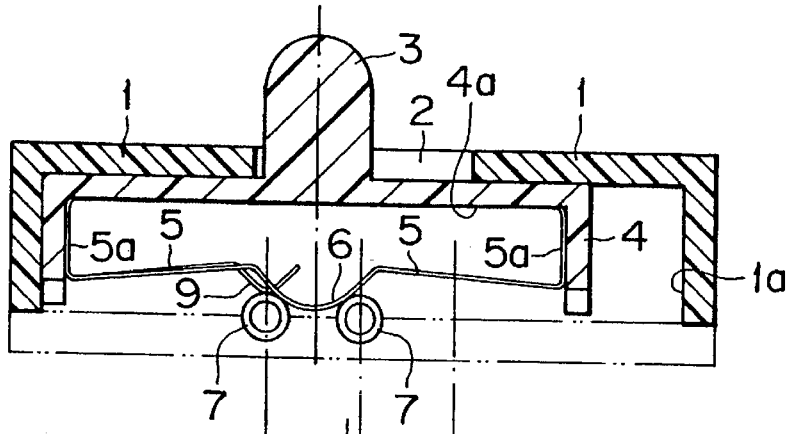
FIG. 8 is a vertical cross-sectional view showing the operating states of a ninth embodiment of the present invention.
Figure 8B:
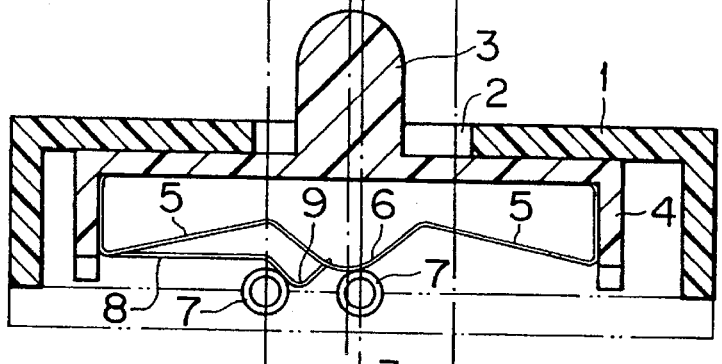
Figure 8C:
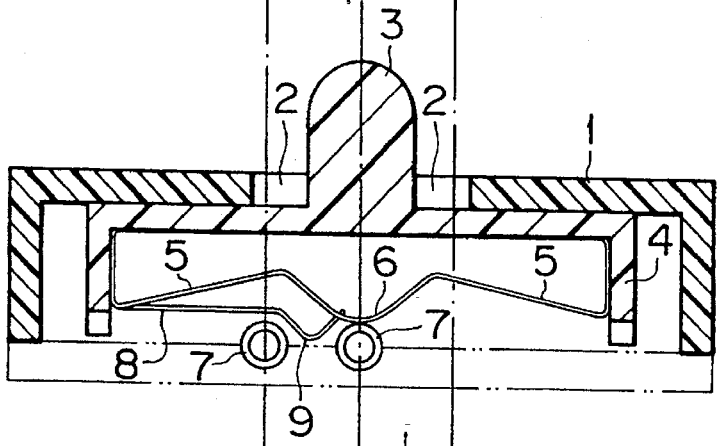
Figure 8D:
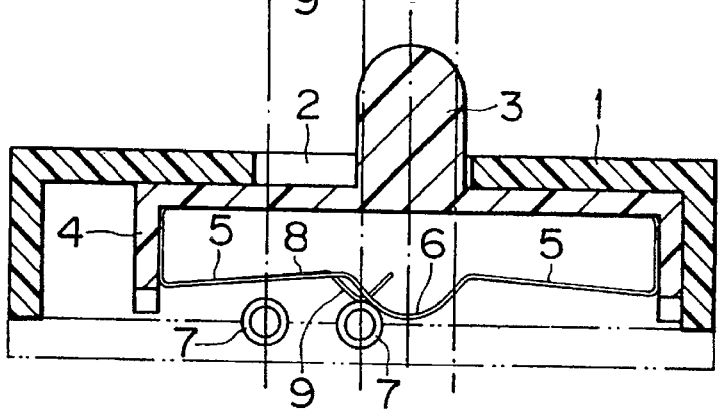
Figure 9A:
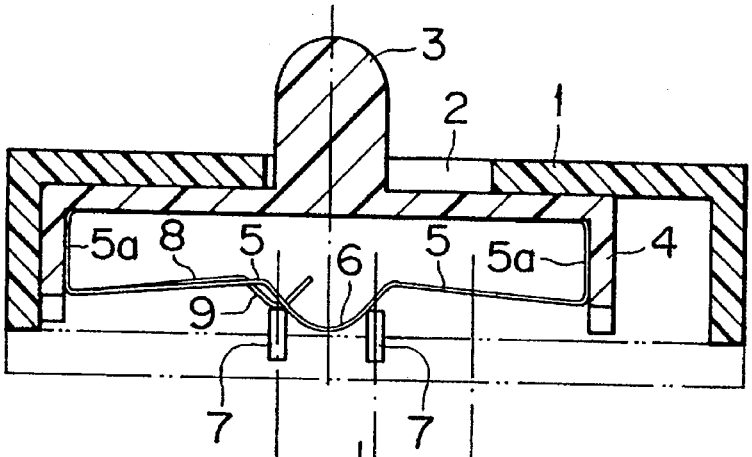
FIG. 9 is a vertical cross-sectional view showing the operating states of a tenth embodiment of the present invention.
Figure 9B:
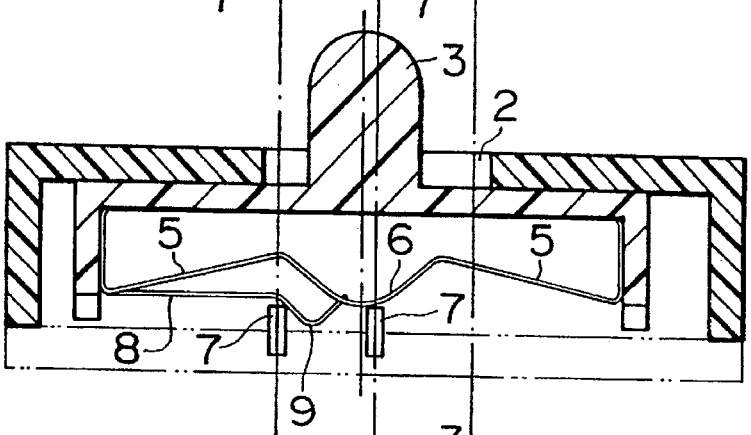
Figure 9C:
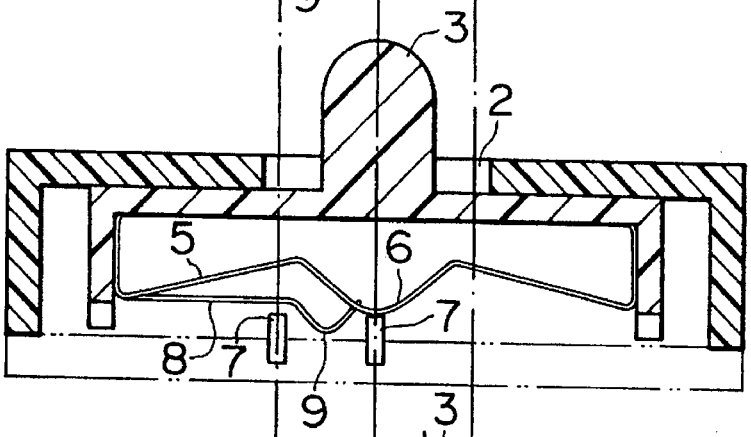
Figure 9D:
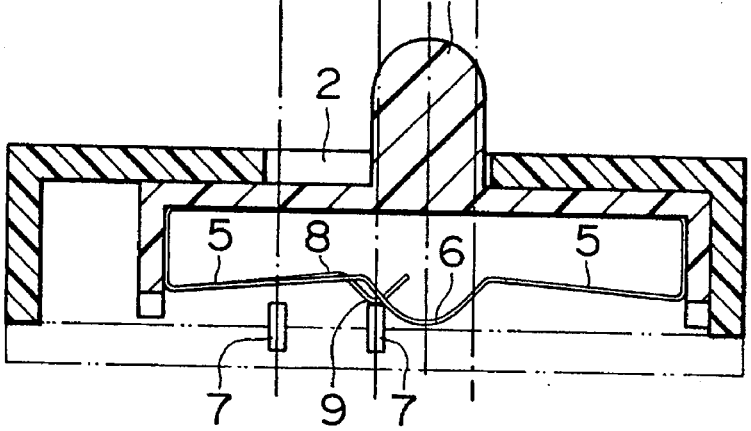
Figure 10A:
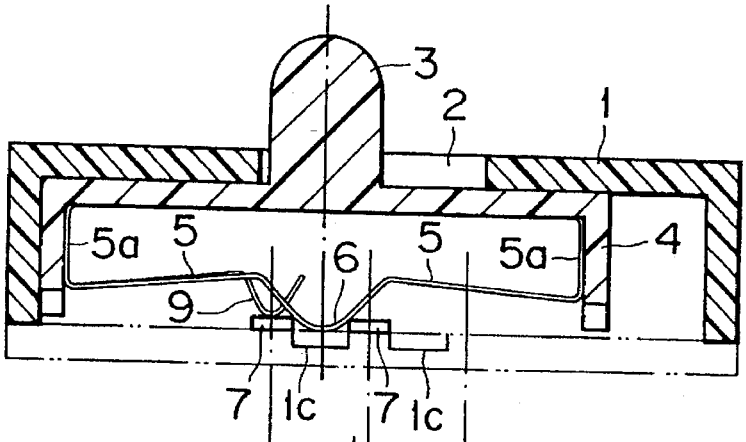
FIG. 10 is a vertical cross-sectional view showing the operating states of an eleventh embodiment of the present invention.
Figure 10B:
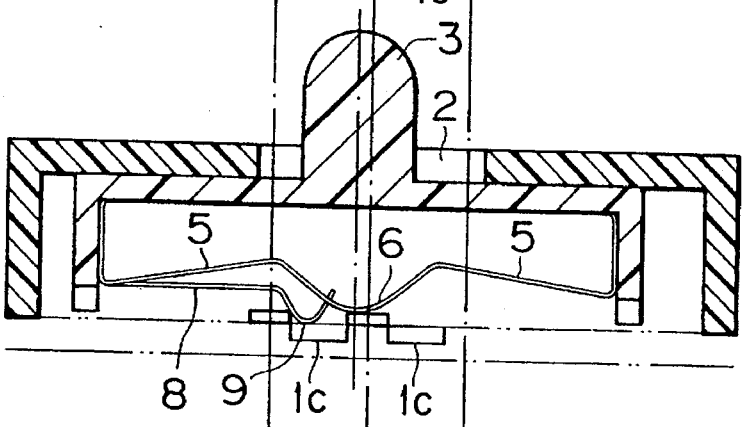
Figure 10C:
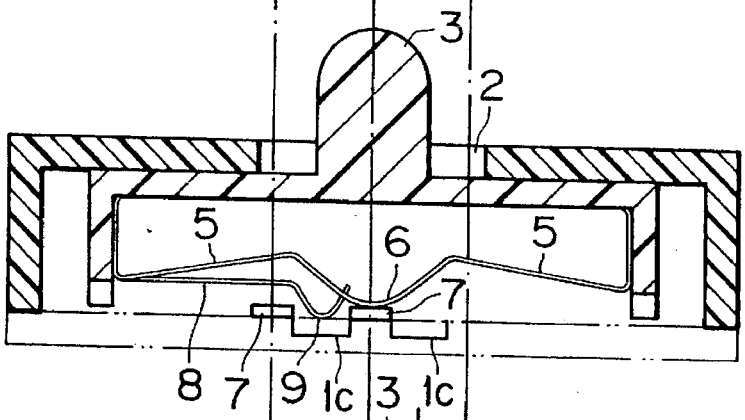
Figure 10D:
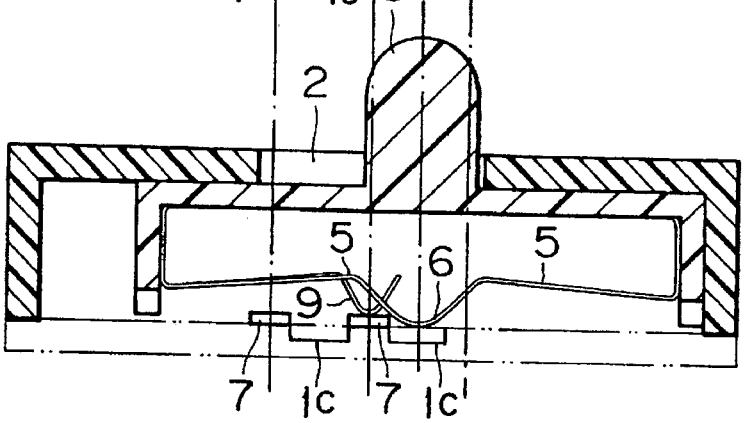
Figure 11A:
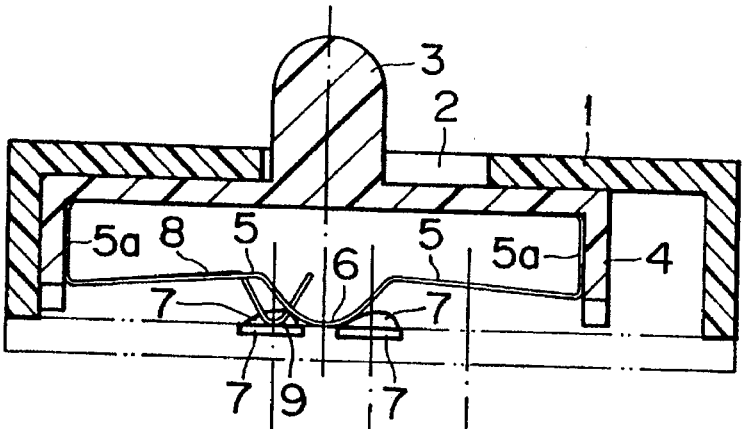
FIG. 11 is a vertical cross-sectional view showing the operating states of a twelfth embodiment of the present invention.
Figure 11B:
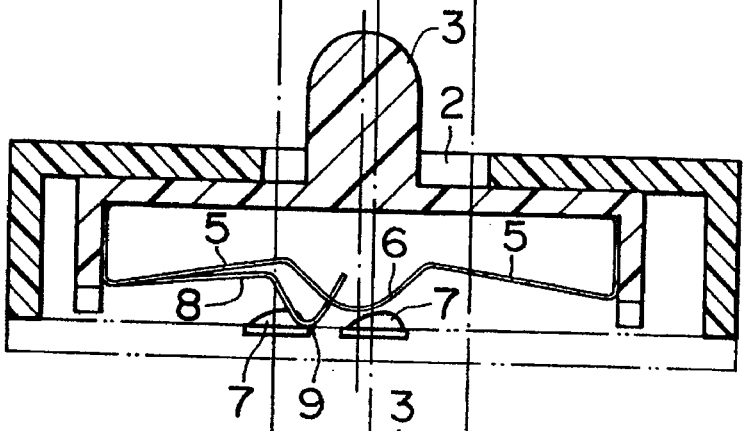
Figure 11C:
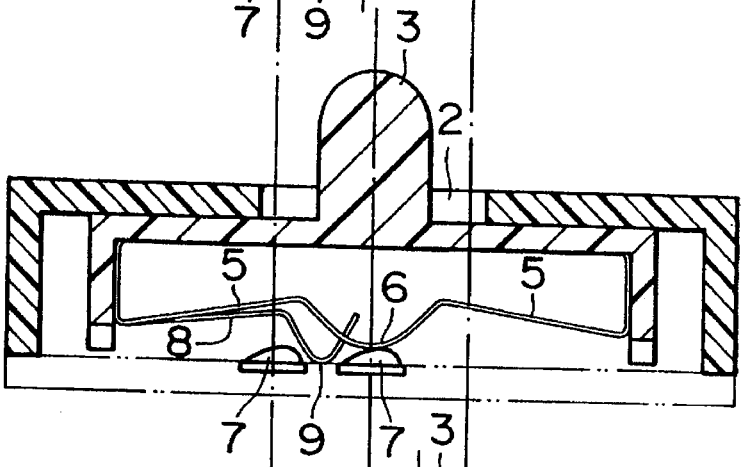
Figure 11D:
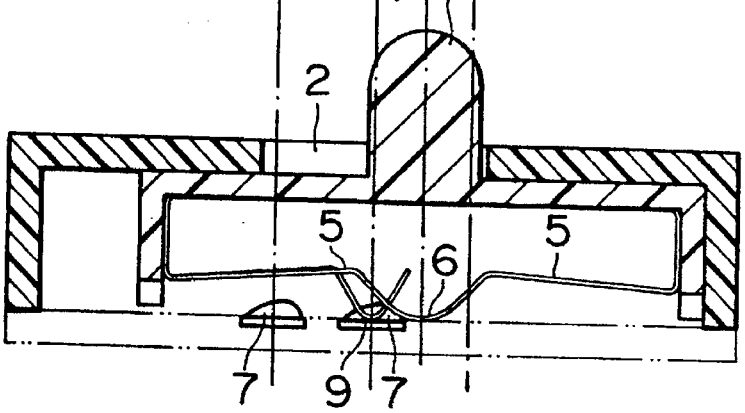
Figure 12A:
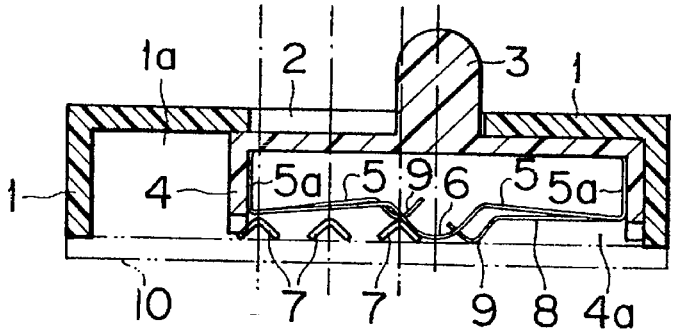
FIG. 12 is a vertical cross-sectional view showing the sliding operation of a slide switch as claimed in another embodiment of the present invention.
Figure 12B:
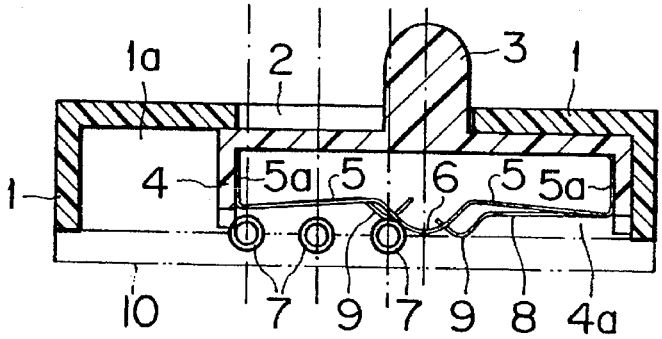
Figure 12C:
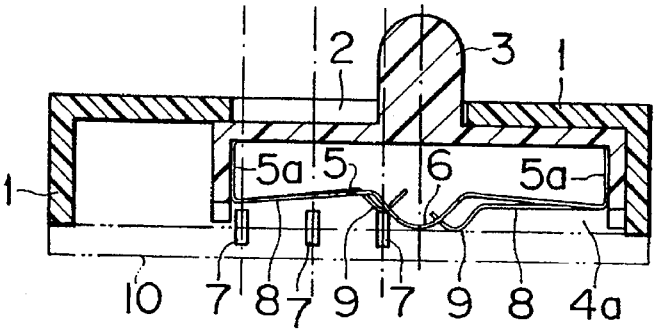
Figure 12D:
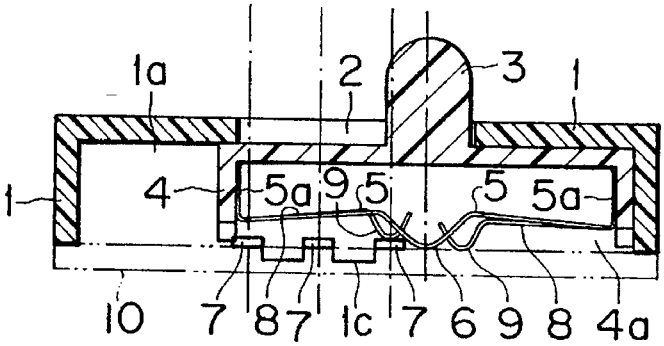
Figure 12E:
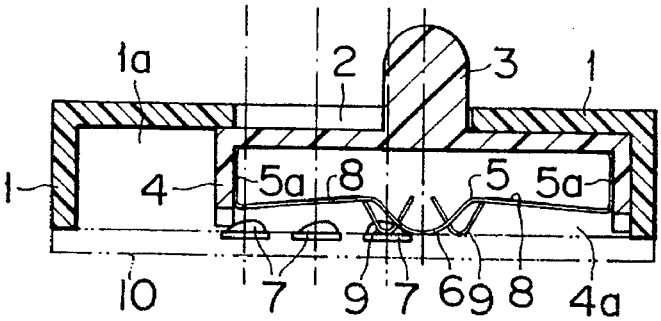

Further embodiments of the present invention are shown in FIGS. 5 and 6. Each of the embodiments shown in FIGS. 5 and 6 is similar to the embodiments described above with respect to FIGS. 1–3 and 4, respectively. However, in each embodiment, the hollow slider 4 is in the form of an inverted "U" with each end being equipped with slide posts 4A.

The state of the switch shown in FIG. 6 immediately after assembly is such that, protrusion 6 of resilient conductive strip 5 partially drops between, for example, the left and central stationary contacts 7 of three stationary contacts 7 due to the deflecting resiliency of the above-mentioned resilient conductive strip 5 itself as shown in FIG. 7(*a*). This, in turn, causes the protrusion 6 to make resilient contact by straddling the two stationary contacts 7. The switch is turned on as a result of shorting between the two left stationary contacts 7 with protrusion 6 of said resilient conductive strip 5. At this time, each auxiliary protrusion 9 of two auxiliary resilient strips 8 makes resilient contact with the upper portion of central and left stationary contact 7, respectively, due to their own resiliency.

Next, in order to turn the switch off from the on state described above, when knob 3, for example, is moved to the right in the off direction, the protrusion 6 of resilient conductive strip 5 will first release from the right slope of left stationary contact 7. The protrusion 6 of the resilient conductive strip 5 will then ride up onto right stationary contact 7 in opposition to its deflecting resiliency as shown in FIG. 7(*b*). At this time, the auxiliary protrusions 9 of each auxiliary resilient strip 8 are still making resilient contact with the right slope of each of the left and central stationary contacts 7 as shown in FIG. 7(*b*), thereby maintaining the switch in the on state with the knob shifted to the left. In this state, there is continuity between the above-mentioned. two stationary contacts 7 due to the continuity path extending from protrusion 6 of resilient conductive strip 5 to auxiliary protrusions 9 of auxiliary resilient strips 8 via resilient strip bases 5*a*. That is, the switch is not turned off even if knob 3 is moved by roughly half the length of the width of stationary contacts 7.

Continued movement of the knob 3 will cause the protrusion 6 of resilient conductive strip 5 to become aligned with the upper portion of right stationary contact 7 as shown in FIG. 7(*c*). Thereafter, it begins to lower as shown in FIG. 7(*d*). Although it stabilizes after lowering completely as shown in FIG. 7(*e*), prior to that, auxiliary protrusions 9 first release from each of the slopes of stationary contacts 7 on both the left and right sides as shown in FIG. 7(*c*) resulting in the switch being turned off. After having gone through this off state, as the above-mentioned protrusion 6 of resilient conductive strip 5 begins to move down central stationary contact 7, each auxiliary protrusion 9 makes contact with the left slope of each of the central and right stationary contacts 7, thereby causing the switch to begin to be switched on with knob 3 shifted to the right. In this state, there is continuity between the above-mentioned two stationary contacts 7 due to the continuity path extending, from protrusion 6 of resilient conductive strip 5 to the two protrusions 9 of auxiliary resilient strips 8 via resilient strip bases 5*a*.

Further continued movement of the knob 3 to the left will cause the protrusion 6 of resilient conductive strip 5 to then partially drop between each of the left and central stationary contacts 7 with a clicking action due to the deflecting resiliency of the conductive resilient strip 5 as shown in FIG. 7(*d*). As a result, shorting will occur between each of the right and central stationary contacts 7 to maintain the switch in the on state with knob 3 shifted to the right.

In order to turn the switch off again with the knob 3 shifted to the right-most position, the knob 3 is moved to the left in the opposite direction from that of the operation described above. The protrusion 6 of resilient conductive strip 5 will thus first riding up onto central stationary contact 7 in opposition to the deflecting resiliency of resilient conductive strip 5 as shown in FIGS. 7(*d*) through 7(*c*). The auxiliary protrusions 9 are respectively released from left and right stationary contacts 7, thereby turning the switch off as shown in FIG. 7(*c*).

After this, by moving knob 3 further to the left, auxiliary protrusions 9 respectively make resilient contact with the right slopes of left and central stationary contacts 7, and the switch with knob 3 shifted to the left begins to be turned on as described above. By continuing to move knob 3 to the left, protrusion 6 of resilient conductive strip 5 now partially drops between each left and central stationary contact 7 with a clicking action due to the deflecting resiliency of resilient conductive strip 5 as shown in FIG. 7(*a*), thereby shorting each of the left and central stationary contacts 7 and securing the on state of the switch with the knob shifted to the left.

Although the structure and operation of the slide switch according to first embodiment of the present invention are as described above, the cross-sectional shape of the stationary contacts 7 may vary. Thus, the stationary contacts 7 may be in the form of a triangular crest-shaped protrusion by burring for a prescribed portion of a flat strip as shown in FIGS. 1–2. Alternatively, the stationary contacts 7 may have a cross-sectional structure as shown in each of FIGS. 8(*a*) through 11(*d*).

More specifically, as shown in FIGS. 8(*a*)–8(*d*), the stationary contacts 7 may be in the form of round pipes. The resilient conductive strip protrusion 6 and auxiliary resilient strip protrusion 9 respectively make resilient sliding contact with their upper surfaces.

In addition, as shown in FIGS. 9(*a*)–9(*d*), the stationary contacts 7 may be in the form of vertical plates. The resilient conductive strip protrusion 6 and auxiliary resilient strip protrusion 9 respectively make resilient sliding 3 contact with their upper surfaces.

Moreover, as shown in FIGS. 10(*a*)–10(*d*), the stationary contacts 7 may be in the shape of flat plates. The resilient conductive strip protrusion 6 and auxiliary resilient strip protrusion 9 respectively make resilient sliding contact with their upper surfaces. The on state is thus stable as a result of protrusion 6 partially dropping between these flat plate shaped stationary contacts 7.

As shown in FIGS. 11(*a*)–11(*d*), the stationary contacts 7 are formed from flat plates, a portion of which is formed into the shape of crests. Resilient conductive strip protrusion 6 thus makes sliding contact with the upper surface of that crest, while auxiliary resilient strip protrusion 9 makes resilient sliding contact with the flat portion adjacent to the crested portion.

Moreover, auxiliary resilient strip 8, which is a portion of a moving contact, may be respectively extending from two resilient strip bases 5*a* on both sides of the above-mentioned resilient conductive strip 5 as shown in FIG. 13A, and auxiliary protrusion 9 may be formed intermediate to it.

By extending each of the lengths of insulating base 1, its recession 1*a* and opening 2 in the present invention slightly more in the right direction than in each of the embodiments described previously, the range of movement to the right of slider 4 can be increased beyond that of the state in FIG. 7(*e*), thus obtaining a state in which the switch is completely off as a result of all moving contact projections 6 and 9 leaving the two gaps between the three stationary contacts 7. Such an embodiment is shown in FIGS. 12(*a*) through 12(*e*), using the various shapes for the stationary contacts 7 described above.

Figure 14:
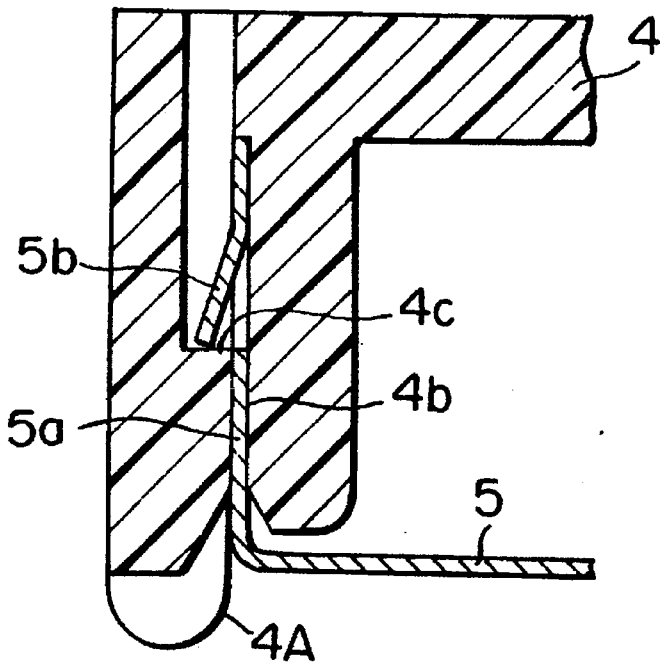
FIG. 14 is a partially enlarged cross-sectional view showing an embodiment of a resilient conductive strip as claimed in another embodiment of the present invention.

The resilient conductive strip 5 may be provided with an auxiliary resilient strip 8 from a single resilient strip base 5*a* as shown by the variations depicted in FIGS. 13A–13C. One (or both as the case may be) of the strip bases 5*a* may also be provided with protruding locking tabs 5*b*. That is, as shown in FIG. 14, the resilient locking tab 5*b* formed in a downward slope facing to the outside on the resilient strip base 5*a* may be inserted into the insertion groove 4*b* in opposition to the locking tab's resiliency. The locking tab 5*b* will thus be locked against the ledge 4*c* of the slider 4.

Figure 15:
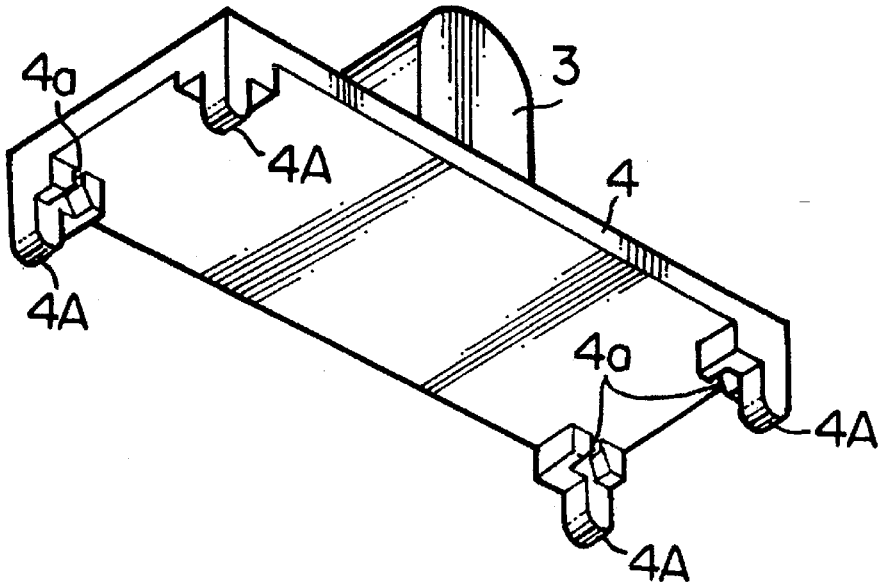
FIG. 15 is a perspective view showing another example of a slider.

The slider 4 itself can also be provided with slide posts 4A, having a lower height protruding from the four corners of a plate as shown in FIG. 15. The bases 5*a* may thus be inserted into the insertion grooves 4*b* provided on the bases of the slide posts 4A, thereby imparting a relatively flat shape to the switch of this invention.

We claim:

1. A slide switch comprising:

an electrically insulated support housing having an interior cavity and having an upper wall which defines an opening in communication with said interior cavity;

an electrically insulated slide body which is slidably disposed within said interior cavity of said support housing so as to be slidably movable reciprocally in an operation direction between first and second positions, said slide body having a knob which projects through said opening defined in said upper wall of said support housing to allow manual movement of said slide body between said first and second positions; and at least one pair of fixed contacts each disposed parallel, but spaced apart relative, to one another substantially transverse to said operation direction of said slide body, wherein said slide body also includes a movable contact sized and configured to be in contact with said pair of fixed conductors when said slide body is in said first position so as to make an electrical circuit therebetween, and to be disengaged from at least one of said fixed conductors when said slide body is in said second position so as to break electrical contact therebetween; and wherein said movable contact includes a main elongate contact strip and an auxiliary elongate contact strip disposed in parallel side-by-side relationship to one another in said operation direction of said slide body, said main contact strip including a main protrusion for contacting said pair of fixed contacts when said slide body is in said first position thereof, and said auxiliary contact strip including an auxiliary protrusion spaced from said main protrusion in said operation direction of said slide body for contacting one of said fixed contacts when said slide body is being moved from said first position and into said second position to thereby maintain said electrical circuit until said slide body reaches said second position.

2. The slide switch as in claim 1, wherein said moveable contact includes a pair of said auxiliary contact strips, wherein each said auxiliary contact strip is positioned on a respective lateral side of said main contact strip and oriented parallel thereto.

3. The slide switch as in claim 2, wherein said moveable contact includes a pair of upright stip bases separated from one another in said operation direction, and wherein said main and auxiliary contact strips extend between both said strip bases.

4. The slide switch of claim 2, wherein said moveable contact includes a pair of upright strip bases separated from one another in said operation direction, and wherein said main contact strip extends between said strip bases, and said auxiliary contact strips extend from a respective one of said strip bases.

5. The slide switch of claim 1, wherein said moveable contact includes a pair of upright strip bases separated from one another in said operation direction, and wherein said main contact strip extends between said strip bases, and said auxiliary contact strip extends from one of said strip bases.

6. The slide switch of any one of claims 2–5, wherein said slide body includes insertion grooves, and wherein said strip bases are inserted into said insertion grooves.

7. The slide switch of claim 1, having three of said fixed contacts.

8. The slide switch of claim 1, wherein said slide body has an open bottom.

9. The slide switch of claim 1, wherein said slide body has an inverted U-shaped form.

10. The slide switch of claim 1, wherein said fixed contacts are in the form of round pipes.

11. The slide switch of claim 1, wherein said fixed contacts are in the form of flat plates.

12. The slide switch of claim 11, wherein said flat plate fixed contacts are oriented vertically.

13. The slide switch of claim 11, wherein said flat plate fixed contacts are oriented horizontally.

14. The slide switch of claim 1, wherein said fixed contacts includes a crested portion and a flat portion adjacent said crested portion.

15. The slide switch of claim 14, wherein said main protrusion makes contact with said crested portion of said fixed contact, and said auxiliary protrusion makes contact with said flat portion.

16. The slide switch of claim 1, wherein said slide body is substantially flat, and includes slide posts at each corner thereof.

* * * * *